US006682237B2

(12) United States Patent
Cocklin et al.

(10) Patent No.: US 6,682,237 B2
(45) Date of Patent: Jan. 27, 2004

(54) APPARATUS AND METHOD FOR TRANSPORTING PRINT MEDIA THROUGH A PRINTZONE OF A PRINTING DEVICE

(75) Inventors: Thomas Cocklin, Portland, OR (US); Richard L. Brinkly, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 137 days.

(21) Appl. No.: 09/952,147

(22) Filed: Sep. 11, 2001

(65) Prior Publication Data

US 2003/0049067 A1 Mar. 13, 2003

(51) Int. Cl.[7] ..... B41J 11/00

(52) U.S. Cl. ..... 400/624; 400/578; 400/605; 400/625; 271/301; 271/302; 399/393

(58) Field of Search ..... 271/8.1, 9.01, 271/9.02, 301, 302, 3.01, 3.08; 400/578, 605, 608.1, 608.2, 624, 625; 399/393

(56) References Cited

U.S. PATENT DOCUMENTS

| | | | | | |
|---|---|---|---|---|---|
| 4,431,322 | A | * | 2/1984 | Nally et al. | 400/605 |
| 5,221,951 | A | * | 6/1993 | Sakamoto | 399/393 |
| 5,327,207 | A | * | 7/1994 | Otake et al. | 399/364 |
| 5,448,348 | A | * | 9/1995 | Azeta | 399/364 |
| 5,565,970 | A | * | 10/1996 | Suda | 399/406 |
| 5,772,197 | A | | 6/1998 | Aoki | |
| 6,078,762 | A | * | 6/2000 | Fuchiwaki et al. | 399/94 |
| 6,203,001 | B1 | | 3/2001 | Steinhilber | |
| 6,312,173 | B1 | * | 11/2001 | Hashimoto et al. | 400/70 |
| 6,354,585 | B1 | * | 3/2002 | Takahashi | 271/97 |
| 6,450,711 | B1 | * | 9/2002 | Conrow | 400/582 |
| 6,454,478 | B2 | * | 9/2002 | Wotton et al. | 400/656 |

* cited by examiner

*Primary Examiner*—Andrew H. Hirshfeld
*Assistant Examiner*—Dave A Ghatt

(57) ABSTRACT

An apparatus and method are disclosed herein for enabling dual-loading of print media through a printzone of a printing device. Further characteristics and features of the present invention are additionally disclosed herein, as are exemplary alternative embodiments. This abstract is not to be used in the interpretation of any of the claims.

19 Claims, 1 Drawing Sheet

APPARATUS AND METHOD FOR TRANSPORTING PRINT MEDIA THROUGH A PRINTZONE OF A PRINTING DEVICE

BACKGROUND AND SUMMARY

The present invention relates to printing devices. More particularly, the present invention relates to an apparatus and method enabling dual-loading of print media through a printzone of a printing device.

Printing devices, such as inkjet printers and laser printers, use printing composition (e.g., ink or toner) to print images (text, graphics, etc.) onto a print medium in a printzone of the printing device. Inkjet printers may use print cartridges, also known as "pens", which deposit printing composition, referred to generally herein as "ink", onto a print medium such as paper, labels, forms, transparencies, or fabric. Each pen has a printhead that includes a plurality of nozzles. Each nozzle has an orifice through which the printing composition is ejected. To print an image, the printhead is propelled back and forth across the print medium by, for example, a carriage while ejecting printing composition in a desired pattern as the printhead moves. The particular ink ejection mechanism within the printhead may take on a variety of different forms known to those skilled in the art, such as thermal printhead technology. For thermal printheads, the ink may be a liquid, with dissolved colorants or pigments dispersed in a solvent.

Printing devices typically include an input tray which houses a supply of print media. Some printing devices have multiple input trays that allow different types (e.g., size, color, weight, composition, etc.) of print media to be used in a printing device. Multiple input trays also allow back-up supplies of print media to be available so a user doesn't have to load print media into a printing device as often. During operation of a printing device, a print medium is selected from an input tray. Once a print medium has been acquired from the input tray, it is transported to the printzone for printing. Subsequent to printing in the printzone, the print medium is ejected from the printing device.

A user of a printing device may sometimes desire to finish print media subsequent to initial printing. Finishing can include things such as duplex printing where printing composition is deposited on both sides of a print medium, collating, stapling, sorting or trimming. Other times, a print medium is merely ejected to an output bin without finishing where it can be collected by a user of the printing device.

Ideally, a printing device would be constructed to accommodate both those cases where a user desires to utilize a finishing device and those cases where a user does not. Such a printing device would also ideally be constructed to allow easy access to print media in either the output bin or the finishing device. The present invention is directed to just such a printing device.

An embodiment of an apparatus in accordance with the present invention for use in a printing device having a printzone in which printing occurs includes a supply of print media. The apparatus also includes a primary print medium selection mechanism configured to acquire a print medium from the supply of print media and a primary print media feed path configured to receive the print medium from the primary print media selection mechanism and transport the print medium in a primary direction to the printzone. The apparatus further includes a secondary print medium selection mechanism configured to alternatively acquire the print medium from the supply of print media instead of the primary print medium selection mechanism and a secondary print media feed path configured to receive the print medium from the secondary print medium selection mechanism and transport the print medium in a secondary direction to the printzone.

The above-described embodiment of an apparatus in accordance with the present invention may be modified and include at least the following characteristics, as described below. The primary print medium selection mechanism may include a pick-roller rotatably coupled to an arm which biases the pick-roller against the supply of print media. The secondary print medium selection mechanism may include a pick-roller rotatably coupled to an arm which biases the pick-roller against the supply of print media. The apparatus may further include a processing device coupled to both the primary print media selection mechanism and the secondary print media selection mechanism.

An embodiment of a method in accordance with the present invention for use in a printing device having a supply of print media and a printzone in which printing occurs includes acquiring a print medium from the supply of print media. The method additionally includes selectively transporting the print medium through the printzone in either a primary direction or a secondary direction. The method further includes ejecting the print medium to either an output bin or a finishing device based upon the direction of transport of the print medium through the printzone.

The above-described embodiment of an method in accordance with the present invention may be modified and include at least the following characteristics, as described below. The method may further include finishing the print medium in the finishing device.

An embodiment of a printing device in accordance with the present invention having a printzone in which printing occurs includes a supply of print media having a primary end and a secondary end. The printing device also includes a print medium transport mechanism configured to selectively acquire a print medium from either the primary end of the supply of print media to transport the selected print medium in a primary direction through the printzone or the secondary end of the supply of print media to transport the selected print medium in a secondary direction through the printzone.

The above-described embodiment of a printing device in accordance with the present invention may be modified and include at least the following characteristics, as described below. The printing device may further include a processing device coupled to the print medium transport mechanism and configured to control selective acquisition of the print medium from either the primary end or the secondary end of the supply of print media. The print medium transport mechanism may include a vacuum platen and a belt. Alternatively or additionally, the print medium transport mechanism may include a primary print medium selection mechanism positioned adjacent to and configured to acquire the print medium from the primary end of the supply of print media. In such cases, the print medium transport mechanism may also include a secondary print medium selection mechanism positioned adjacent to and configured to alternatively acquire the print medium from the secondary end of the supply of print media.

The printing device may further include an output bin into which the print media traveling in the primary direction is ejected subsequent to exiting the printzone. The printing device may also further include a finishing device into which the print media traveling in the secondary direction is ejected subsequent to exiting the printzone.

An alternative embodiment of a method in accordance with the present invention for use in a printing device having a supply of print media, a printzone in which printing occurs, a primary output opening, and a secondary output opening includes selectively acquiring a print medium from one of two locations of the supply of print media. The method additionally includes selectively transporting the print medium through the printzone in one of two directions based upon the location from which the print medium is acquired. The method further includes selectively outputting the print medium through either the primary output opening or the secondary output opening based upon the direction of travel of the print medium through the print zone.

The above-described alternative embodiment of a method in accordance with the present invention may be modified and include at least the following characteristics, as described below. The method may further include finishing the print medium outputted through the secondary opening.

An alternative embodiment of an apparatus in accordance with the present invention for use in a printing device having a printzone in which printing occurs includes structure for supplying print media. The apparatus also includes structure for acquiring print media from the structure for supplying print media and structure for selectively transporting acquired print media in either a primary direction through the printzone or a secondary direction through the printzone. The apparatus further includes structure for receiving print media traveling in the primary direction and structure for finishing print media traveling in the secondary direction.

The foregoing summary is not intended by the inventors to be an inclusive list of all the aspects, advantages, and features of the present invention, nor should any limitation on the scope of the invention be implied therefrom. This summary is provided in accordance with 37 C.F.R. Section 1.73 and M.P.E.P. Section 608.01(d). Other objects, advantages, and novel features of the present invention will become apparent from the following detailed description when considered in conjunction with the accompanying drawings.

DETAILED DESCRIPTION OF THE DRAWINGS

Figure 1:
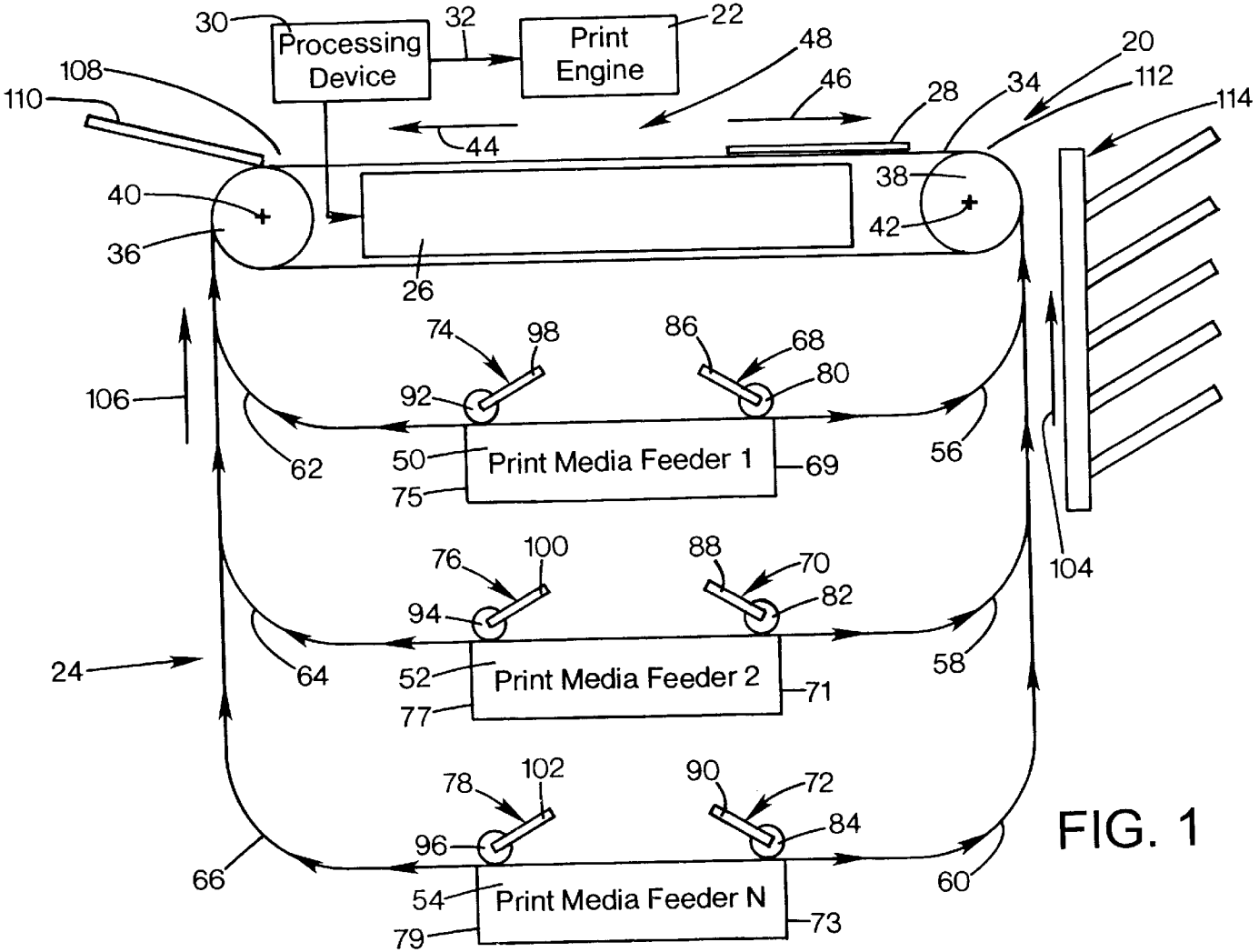
FIG. 1 is a diagrammatic view of a printing device that includes an embodiment of the present invention.

FIG. 1 is a diagrammatic view of an inkjet printing device 20 that includes an embodiment of the present invention and which may be used for printing business reports, correspondence, desktop publishing, and the like. A variety of printing devices are commercially available. For instance, some of the printing devices that may embody the present invention include printers, plotters, copiers, and facsimile machines, to name a few, as well as various combination devices, such as combination facsimiles and printers. In addition, the present invention may be used in a variety of types of printing devices such as inkjet printers and laser printers.

Some of the major elements of printing device 20 are shown in FIG. 1, including print engine 22, print medium transport mechanism 24 in accordance with the present invention, and vacuum platen 26. Print engine 22 may comprise any type of apparatus by which an image is recorded on print medium 28, including inkjet printing mechanisms and laser mechanisms. A processing device 30 is used to control formation of images on print medium 28 by print engine 22, as generally indicated by arrow 32. Processing device 30 often receives instructions from a host device, typically a computer, such as a personal computer (not shown). Many of the functions of processing device 30 may be performed by a host computer (not shown), including any printing device 20 drivers resident on the host computer, by electronics (also not shown) in printing device 20, or by interactions between the host computer and the electronics. As used herein, the term "processing device 30" encompass these functions, whether performed by a host device, printing device 20, an intermediary device between the host device and printing device 20, or by combined interaction of such elements.

Print medium transport mechanism 24 also includes a porous belt 34 that is disposed around a pair of driven rollers 36 and 38. Rollers 36 and 38 may be selectively driven by processing device 30 of printing device 20 and one or more motors and drive gears (which are not shown) so as to rotate about points 40 and 42 in either a clockwise or counter-clockwise direction which allows porous belt 34 to selectively move in either of the directions indicated by arrows 44 and 46. Porous belt 34 is in fluid communication with vacuum platen 26 by, for example, a plurality of apertures (not shown) formed though porous belt 34. In this manner, print medium 28 is held against porous belt 34 for the span of the length of vacuum platen 26 and can be moved to and from printzone 48 any number of times. This span may be changed by resizing the dimensions of vacuum platen 26.

As can also be seen in FIG. 1, printing device 20 also includes a plurality of supplies of print media in the form of print media feeders 50, 52, and 54. Feeders 50, 52, and 54 each include a tray for sheets of print media, as well as the necessary components to selectively transport print media to printzone 48 of printing device 20 via print media feed paths 56, 58, and 60 or print media feed paths 62, 64, and 66, as discussed more fully below. Feeders 50, 52, and 54 may each be separately configured to hold various sized print media or, alternatively, fixed sized print media. As discussed more fully below, processing device 30 of printing device 20 is also coupled to each of feeders 50, 52, and 54 to control selective transport of print media from any one of feeders 50, 52, and 54 to printzone 48 for printing of images by print engine 22. The present invention may be used with printing devices having any number of print media input trays and/or racks which is noted in FIG. 1 through the use of the designation "Feeder N" for feeder 54.

Each of feeders 50, 52, and 54 includes a respective primary print medium selection mechanism 68, 70, and 72 located at respective primary ends 69, 71, and 73 of feeders 50, 52, and 54. Each of feeders 50, 52, and 54 also includes a respective secondary print medium selection mechanism 74, 76, and 78 located at respective secondary ends 75, 77, and 79 of feeders 50, 52, and 54. Processing device 30 is coupled to each of primary and secondary print medium selection mechanism 68, 70, 72, 74, 76, and 78 to selectively control operation thereof in the manner more fully discussed below.

As can be seen in FIG. 1, each of primary print medium selection mechanisms 68, 70, and 72 includes a respective pick-roller 80, 82, and 84 rotatably coupled to a respective arm 86, 88, and 90. Arms 86, 88, and 90 bias respective pick-rollers 80, 82, and 84 against the supply of print media in respective feeders 50, 52, and 54. Each of secondary print medium selection mechanisms 74, 76, and 78 includes a respective pick-roller 92, 94, and 96 rotatably coupled to a respective arm 98, 100, and 102. Arms 98, 100, and 102 bias respective pick-rollers 92, 94, and 96 against the supply of print media in respective feeders 50, 52, and 54.

In operation in accordance with the present invention, processing device 30 controls one of the primary print medium selection mechanisms 68, 70, and 72 or the secondary print medium selection mechanisms 74, 76, and 78 to selectively acquire a print medium from either the primary end or secondary end of one of the supplies of print media 50, 52 or 54. A print medium selected by any of primary print medium selection mechanisms 68, 70 or 72 is transported in a primary direction, generally indicated by arrow 104, by one of feed paths 56, 58 or 60 to printzone 48 for printing by print engine 22. A print medium selected by any of secondary print medium selection mechanisms 74, 76 or 78 is transported in a secondary direction, generally indicated by arrow 106, by one of feed paths 62, 64 or 66 to printzone 48 for printing by print engine 22.

In accordance with the present invention, subsequent to printing by print engine 22 and exiting printzone 48, a print medium traveling in primary direction 104 is ejected through a primary output opening at 108 to output bin 110. Also in accordance with the present invention, subsequent to printing by print engine 22 and exiting printzone 48, a print medium traveling in secondary direction 106 is ejected through a secondary output opening at 112 to finishing device 114.

Print media residing in output bin 110 may be manually removed by a user of printing device 20 at any time. Finishing device 114 is only diagrammatically illustrated in FIG. 1 and may include any of a variety or combination of operations performed on print media subsequent to printing on at least one side. Some of these operations include, for example, duplex printing, where printing composition is deposited on both sides of a print medium, collating, stapling, sorting or trimming.

Although the invention has been described and illustrated in detail, it is to be clearly understood that the same is intended by way of illustration and example only, and is not to be taken necessarily, unless otherwise stated, as an express limitation, nor is it intended to be exhaustive or to limit the invention to the precise form or to the exemplary embodiments disclosed. Modifications and variations may well be apparent to those skilled in the art. Similarly, any method elements described may be interchangeable with other method elements in order to achieve the same result. The spirit and scope of the present invention are to be limited only by the terms of the following claims.

Reference to an element in the singular is not intended to mean "one and only one" unless explicitly so stated, but rather means "one or more." Moreover, no element or component in the present specification is intended to be dedicated to the public regardless of whether the element or component is explicitly recited in the following claims. Finally, no claim element herein is to be construed under the provisions of 35 U.S.C. Section 112 sixth paragraph, unless the element is expressly recited using the phrase "means for . . . ."

What is claimed is:

1. An apparatus for use in a printing device having a printzone in which printing occurs, comprising:

a supply of print media;

a primary print medium selection mechanism configured to acquire a print medium from the supply of print media;

a primary print media feed path configured to receive the print medium from the primary print medium selection mechanism and transport the print medium in a primary direction through the printzone;

a secondary print medium selection mechanism configured to alternatively acquire the print medium from the supply of print media instead of the primary print medium selection mechanism; and a secondary print media feed path configured to receive the print medium from the secondary print medium selection mechanism and transport the print medium in a secondary direction through the printzone.

2. The apparatus of claim 1, wherein the primary print medium selection mechanism includes a primary pick-roller rotatably coupled to an arm which biases the primary pick-roller against the supply of print media.

3. The apparatus of claim 2, wherein the secondary print medium selection mechanism includes a secondary pick-roller rotatably coupled to an arm which biases the secondary pick-roller against the supply of print media, the primary pick-roller being adjacent to a primary end of the print media supply while the secondary pick-roller is adjacent to a secondary end of the print media supply, the primary and secondary ends being opposite one another.

4. The apparatus of claim 3, further comprising a processing device coupled to both the primary print media selection mechanism and the secondary print media selection mechanism for moving the primary and secondary pick-rollers into and out of engagement with the print media.

5. The apparatus of claim 1, in a printing device.

6. The apparatus of claim 1 wherein the primary direction is different from the secondary direction.

7. The apparatus of claim 6 wherein the primary direction and secondary direction are opposite one another.

8. A method for use in a printing device having a supply of print media and a printzone in which printing occurs, comprising:

acquiring a first print medium and a second print medium from the supply of print media;

transporting the first print medium through the printzone in a primary direction and transporting the second print medium through the printzone in a secondary direction that is opposite the primary direction;

ejecting the first print medium to an output bin; and ejecting the second print medium to a finishing device.

9. The method of claim 8, further comprising finishing the second print medium in the finishing device.

10. The method of claim 8 wherein the transporting step includes holding the first print medium and the second print medium on a belt and moving the belt in one of two opposite directions depending upon whether the first or second print medium is being transported through the printzone.

11. A printing device having a printzone in which printing occurs, comprising:

a supply of print media having a primary end and a secondary end; and a print medium transport mechanism configured to selectively acquire a first print medium from the primary end of the supply of print media to transport the first print medium in a primary direction through the printzone and to acquire a second print medium from the secondary end of the supply of print media to transport the second print medium in a secondary direction through the printzone, the secondary direction being substantially opposite to the primary direction.

12. The printing device of claim 11, further comprising a processing device coupled to the print medium transport mechanism and configured to control selective acquisition of the first and second print medium.

13. The printing device of claim 11, wherein the print medium transport mechanism includes a primary print medium selection mechanism positioned adjacent to and configured to acquire the print medium from the primary end of the supply of print media.

14. The printing device of claim 13, wherein the print medium transport mechanism also includes a secondary print medium selection mechanism positioned adjacent to and configured to alternatively acquire the print medium from the secondary end of the supply of print media.

15. The printing device of claim 11, further comprising an output bin into which the first print medium is ejected subsequent to transport through the printzone.

16. The printing device of claim 15, further comprising a finishing device into which the second print medium is ejected subsequent to transport through the printzone, the output bin and finishing device being on opposite sides of the printing device.

17. The printing device of claim 11, wherein the print medium transport mechanism includes a vacuum platen and a belt that is selectively movable in either of opposite directions for transporting first and second print mediums.

18. An apparatus for use in a printing device having a printzone in which printing occurs, comprising:

means for supplying print media;

means for acquiring print media from the means for supplying print media;

means for selectively transporting acquired print media in a primary direction through the printzone and in a secondary direction through the printzone, the secondary and primary directions being different;

means for receiving print media traveling in the primary direction; and means for finishing print media traveling in the secondary direction.

19. The apparatus of claim 18, in a printing device, and wherein the means for transporting includes a reversible-direction belt for transporting print media through the printzone.

* * * * *